United States Patent [19]

Angelini

[11] Patent Number: 4,840,716

[45] Date of Patent: Jun. 20, 1989

[54] AUTOMATIC PLANT FOR CONTINUOUS ELECTROPLATING TREATMENT OF METAL BARS

[76] Inventor: Sergio Angelini, Residenza del Cantone 061, Segrate (Milan), Italy

[21] Appl. No.: 209,996

[22] Filed: Jun. 22, 1988

[30] Foreign Application Priority Data

Jun. 22, 1987 [IT] Italy ..... 20990 A/87

[51] Int. Cl.[4] ..... C25D 19/00

[52] U.S. Cl. ..... 204/207; 204/209; 204/297 R

[58] Field of Search ..... 204/297 R, 198–199, 204/200–205, 269, 279, 206–210, 211

[56] References Cited

U.S. PATENT DOCUMENTS

| | | | |
|---|---|---|---|
| 1,959,764 | 5/1934 | Potthof | 204/203 |
| 3,751,344 | 8/1973 | Angelini | 204/207 X |
| 3,852,170 | 12/1974 | Angelini | 204/207 X |
| 4,176,015 | 11/1979 | Angelini | 204/206 X |

*Primary Examiner*—Donald R. Valentine
*Attorney, Agent, or Firm*—Herbert Dubno

[57] ABSTRACT

The automatic plant for the continuous electroplating treatment of metal bars according to this invention comprises, in succession, an automatic introduction unit for bars to be treated, a degreasing and cleaning unit for the bars, an electrolytic treatment unit having one or more successive cells and associated devices for electrical contact with the bars in movement, a handling device for the bars, a final polishing or burnishing unit for the bars and an extraction and storage unit for the treated bars, wherein the automatic introduction unit for the bars possesses means for reciprocal electrical and mechanical connection in alignment of the bars successively introduced and the extraction unit possesses means for separating the successive bars and for storing them side by side, the handling device for the bars carrying out an axial movement of them simultaneously with rotation of the bars on themselves.

15 Claims, 4 Drawing Sheets

AUTOMATIC PLANT FOR CONTINUOUS ELECTROPLATING TREATMENT OF METAL BARS

Figure 1:
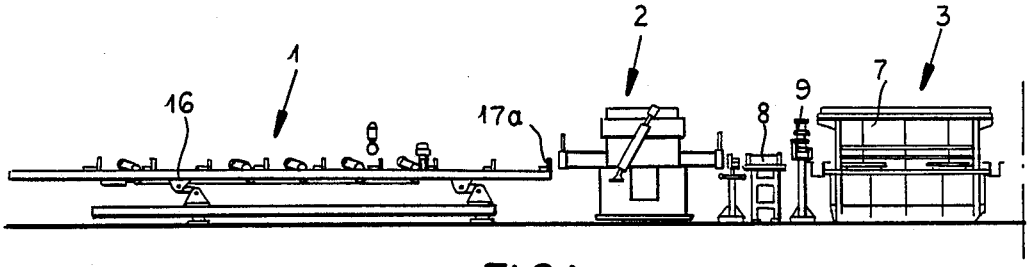

The subject of the present invention is an automatic plant for continuous electroplating treatment of metal bars, especially for chromium-plating of bars.

For many applications, metal bars are used that are provided with a surface coating of a different metal, which imparts to them special properties, such as corrosion resistance, surface hardness, abrasion resistance, bright appearance and the like.

One particularly important example of such treatments is that of chromium-plating treatment, which is carried out on bars used for the construction of movable mechanical devices, such as actuator rods, slide guides and the like, for which devices high surface abrasion resistance and great hardness, and corrosion resistance to the conditions of exposure, are required.

For this purpose, electrolytic plating treatments are carried out, by means of which there is deposited on the surface of the bar a coating of the plating metal, fed to it in the form of positive ions in an electrolytic bath, in which the bar constitutes the cathode, by applying between the bar and an anode immersed in the bath, an electrical voltage which causes the passing of the necessary current.

One important requirement for the carrying out of such an operation is to be able to operate continuously, for the purpose of achieving a high productivity, keeping the operating conditions constant.

For this purpose it is necessary to provide for handling of the bars along the treatment plant, appropriately requiring several consecutive cells, and to ensure continuity between the successively supplied bars, which are of limited length, both in respect of electrical continuity and in respect of surface continuity, so as not to have surface discontinuities between contiguous bars, a possible source of loss from the sealing devices of the cells.

This connection together, as also the supply of the bars to the plant and the inverse operations of separating and storing the bars after treatment, must be capable of being carried out automatically, for the purpose of permitting a reduction to the minimum of the personnel employed for operating the treatment plant.

The problem therefore arises of providing an electrolytic treatment plant for the surface of metal bars, which shall operate continuously and automatically, in this way carrying out the loading of the bars to be treated and the discharge of the treated bars.

Said results are achieved by the present invention, which provides an automatic plant for continuous electroplating treatment of metal bars, which comprises, successively, an automatic introduction unit for bars to be treated, a degreasing and cleaning unit for the bars, an electrolytic treatment unit having one or more consecutive cells and associated devices for electrical contact with the bars in movement, a handling device for the bars, a final burnishing or polishing unit for the bars and an extraction and storage unit for the treated bars, in which the automatic introduction unit for the bars possesses means for the mutual electrical and mechanical connecting together in alignment of the bars successively introduced, and the extraction unit possesses means for separating the successive bars and for storing them side by side, the handling device for the bars carrying out their entrainment in the axial direction and simultaneous rotation of the bars about themselves.

At one end of each bar there are present screw means capable of being coupled to corresponding screw means present at the facing end of the axially contiguous bar, thereby achieving the mechanical connection and electrical connection between the successive bars themselves.

The automatic introduction unit for the bars is composed of a bench having inclined chutes, adapted for receiving the waiting bars, adjacent to a frame equipped with means for rolling support and feed of a bar and equipped with means for rotationally blocking the bar itself, there being provided a transfer apparatus for a single bar, from among the bars present, from the chutes of the bench to the support and feed means, with a movement transverse to the axis of the bar, in which the feed means are adapted for axially feeding the bar present on them into contact with the last of the bars already undergoing treatment in the plant, and the rotational blocking means are adapted for preventing the free rotation of the bar for a preselected period, thereby achieving coupling between the corresponding screw means present respectively on the last bar already undergoing treatment in the plant, which is being rotatably driven, and the next supplied bar, carried by the automatic introduction unit for the bars.

In particular, the means for rolling support of the bars are constituted of pairs of side-by-side rollers, with their axes parallel or forming a small angle to the direction of feed of the bars.

The feed means are composed of motor-driven rollers, having their axes transverse to the feed direction of the bars, situated beneath the level of the support rollers for the bars themselves, capable of being raised to a level higher than that of the rollers themselves in order to determine the feed of the bar resting upon them without rotating it.

The means for rotationally blocking the bar are composed of the feed rollers with transverse axes, exerting friction upon the bar itself, in association with one or more higher rollers having axes transverse to the direction of feed of the bar, each equipped with an actuator for pressing the bar onto the transverse rollers.

The apparatus for transferring a single bar to the support and feed frame for the bar is constituted of at least one pair of arms, oscillating about an intermediate bearing, with their front ends extending as far as the feed axis of the bar on the frame, these arms being equipped with an actuator device for moving them between a raised position, with their front ends at a level higher than the support level of the bar on the supports of the frame, and a lowered position, with their front ends at a level lower than the support level of the bar on the supports of the frame, with their rear ends associated with corresponding bearing projections of the bench carrying the waiting bars and with arresting arms for the bars themselves, which rear ends are equipped with shaped profiles having a depressed end portion, which is aligned, in the raised position of the arms, with the chutes of the bench, and having a step for connection with the upper edge of the arms, the step being aligned, in the raised position, with the bearing projections of the bench.

With advantage, the automatic introduction unit for the bars comprises sensor devices for the rotation of the last bar fed into the plant, adapted for signalling lack of rotation of the bar itself resulting from a defect in its connection to the train of bars undergoing treatment. In particular, the sensor devices for the rotation of the last bar are composed of an electronic detector of angular position rotatably coupled to the last of the pairs of support rollers for the bar in the automatic introduction unit.

The extraction and storage unit for the treated bars is composed of a frame, equipped with rolling support devices for the bars, carrying a carriage movable parallel to the longitudinal axis of the bars, equipped with jaws which can be clamped around the front bar present on the extraction unit, there being present laterally to this a storage bench for the bars, equipped with arms for seizing and transferring the bars onto it, the jaws blocking rotation of the bar clamped by them, during the feed of the carriage parallel to the bar and determining, in this manner, the unscrewing and separation of the screw means which connect the front bar to the next bar.

The corresponding screw means situated at the ends of each bar are constituted, at one end, of a threaded stud projecting axially and, at the opposite end, of a threaded axial hole, adapted for engaging onto the stud projecting from the contiguous bar.

In one form of embodiment, the screw means have a right-hand thread, and in correspondence with them the handling device for the bars causes the bars to rotate in an anticlockwise direction as viewed in the direction of feed of the bars in the plant.

In the plant according to this invention, before and after each electrolytic treatment cell, there is situated a device for electrical contact with the bars advancing in the cell, so as to supply, for each cell, the correct current intensity, without overheating the bars undergoing treatment.

With advantage, the devices for electrical contact with the bars are closed tanks containing a mercury bath. In front of each electrolytic treatment cell, behind the electrical contact device, there is present a device with moving brushes for dressing the surface of the bar, adapted for bringing this surface into the best possible conditions for the electrolytic treatment.

Figure 2:
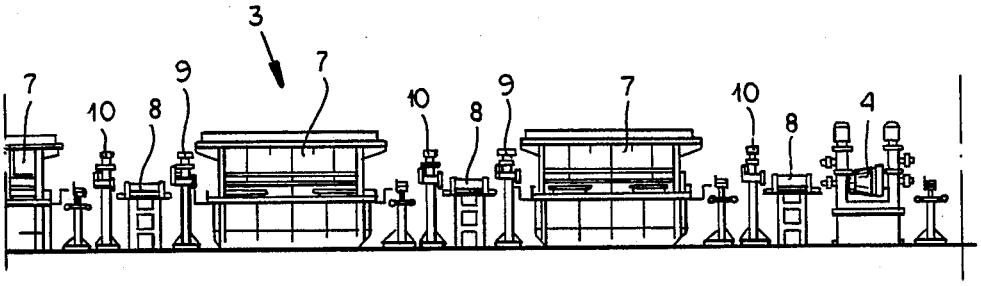
Figure 3:
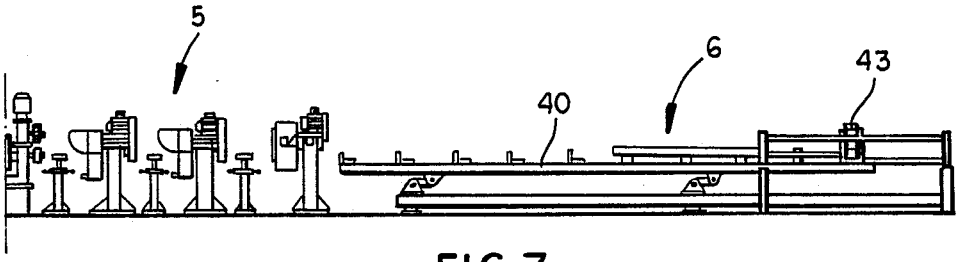
Figure 6:
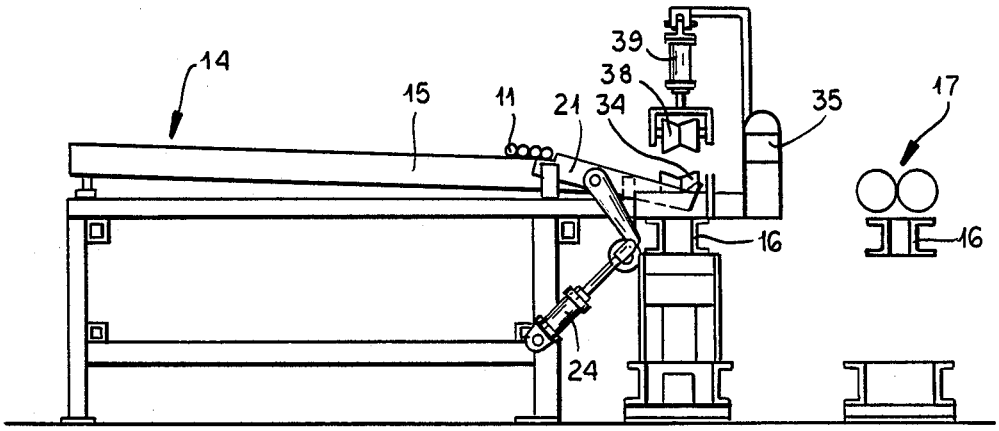
Figure 4:
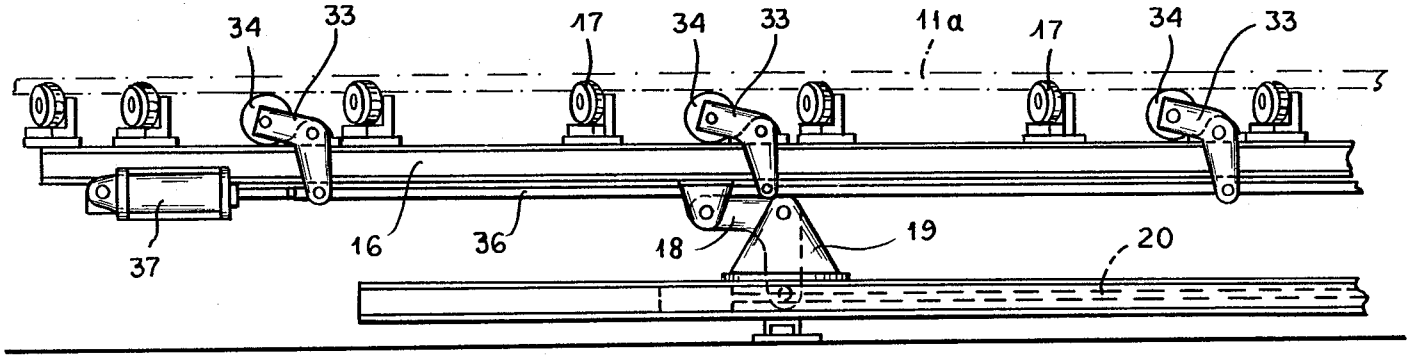
Figure 12:
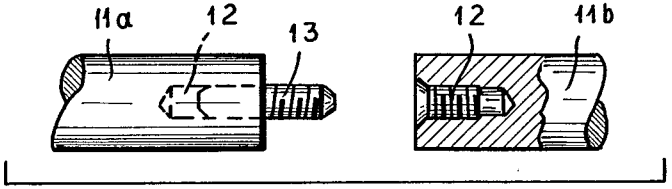
Figure 5:
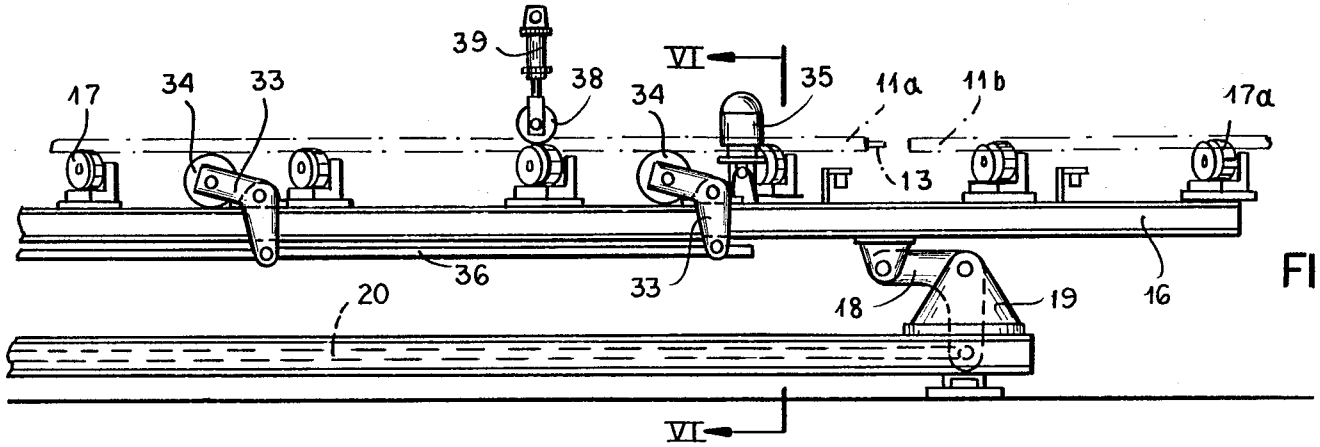
Figure 7:
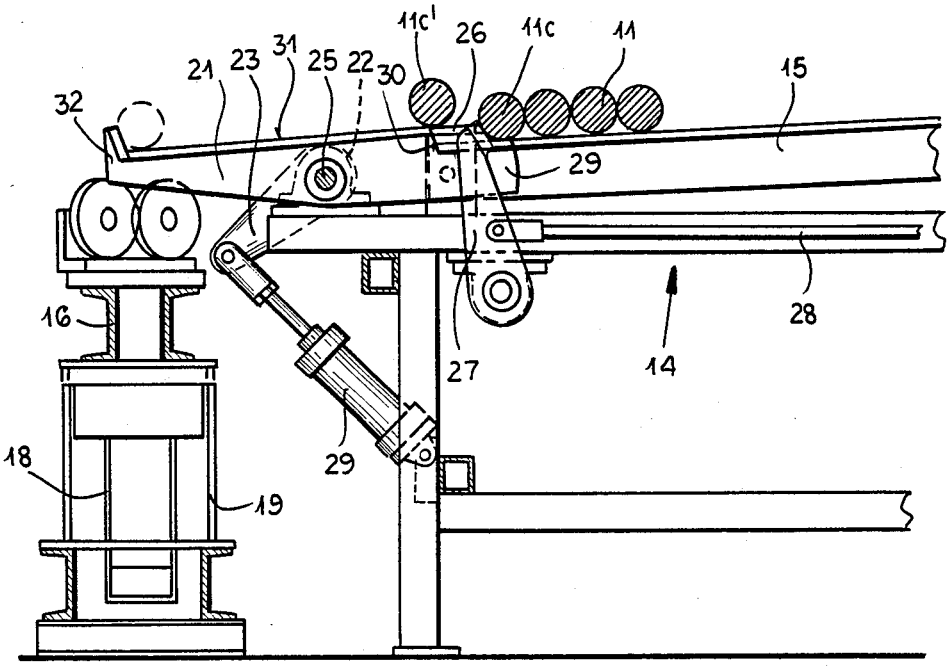
Figure 8:
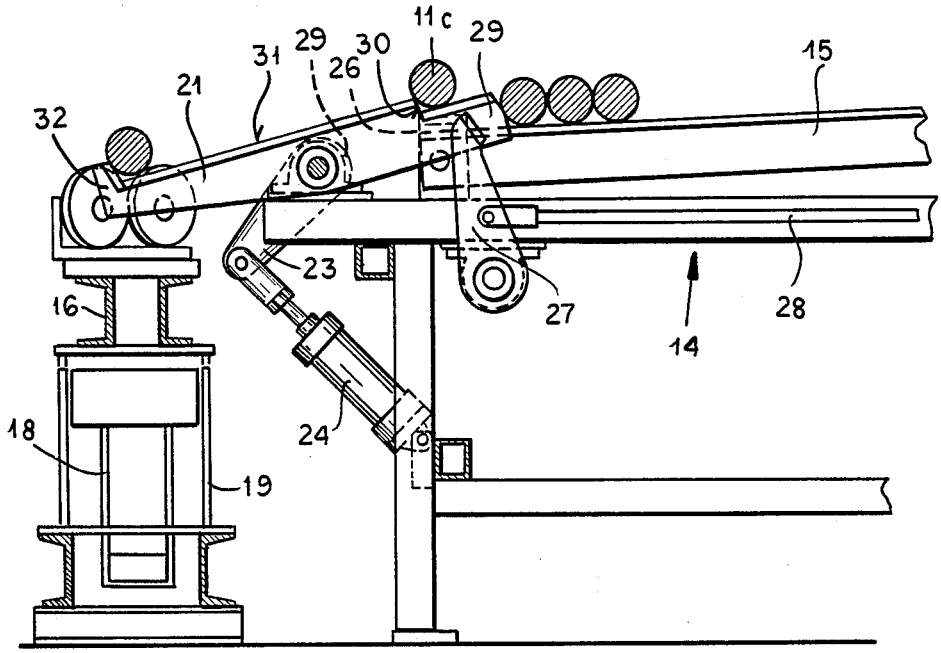
Figure 9:
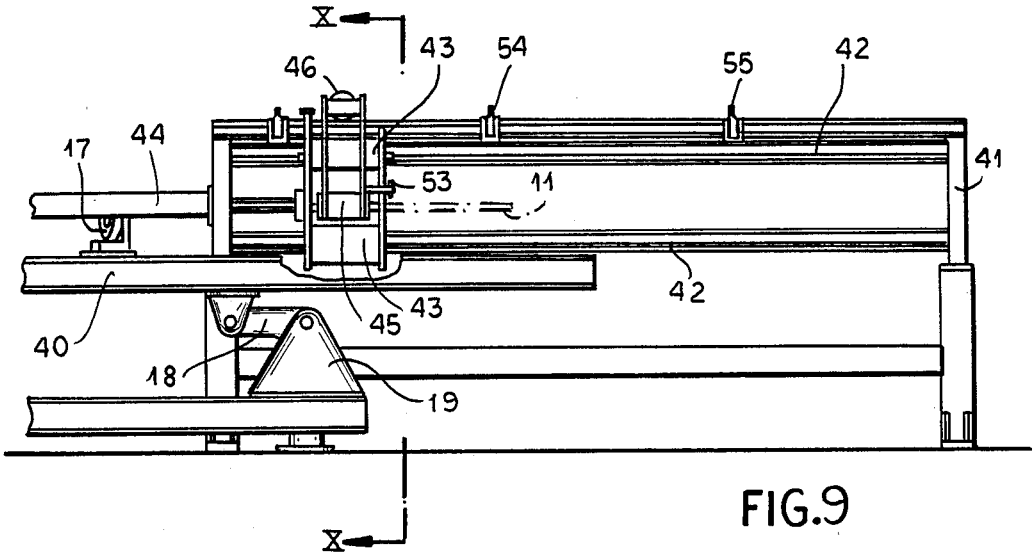
Figure 10:
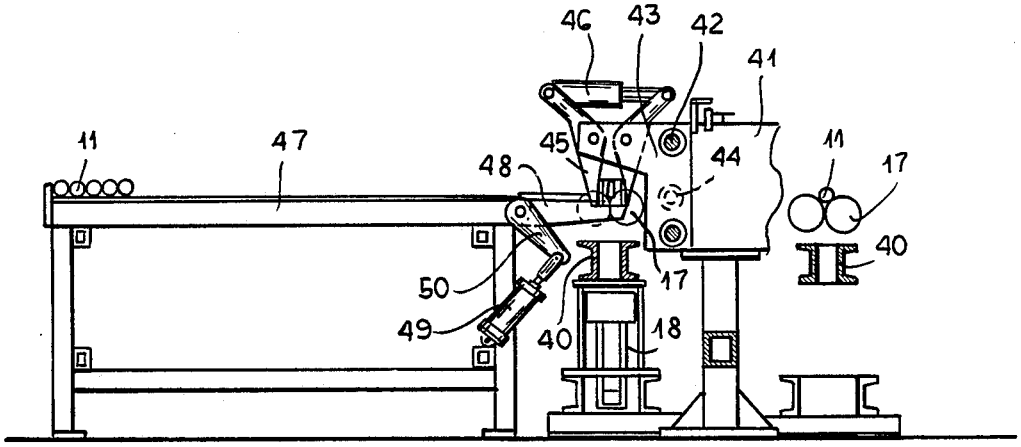
Figure 11:
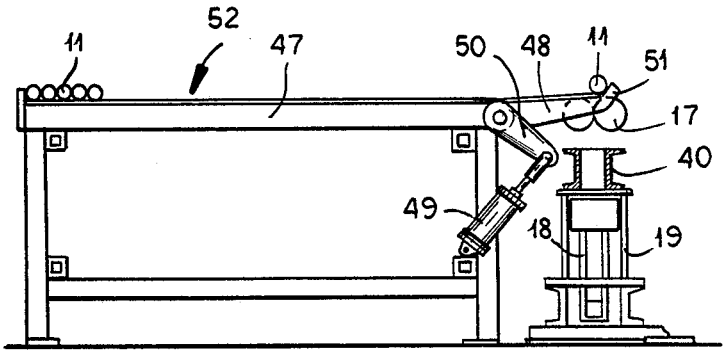

Further details can be obtained from the following description, by reference to the attached drawings, in which there are shown:

in FIG. 1, a general view of the arrangement of the first portion of the plant;

in FIG. 2, a general view of the arrangement of the median portion of the plant;

in FIG. 3, a general view of the arrangement of the last portion of the plant;

in FIG. 4, the first portion of the unit for loading the bars to be chromium-plated, in side view;

in FIG. 5, the second portion of the unit for loading bars of FIG. 4;

in FIG. 6, a section on the plane VI—VI of FIG. 5;

in FIG. 7, the loading unit of FIG. 6, to enlarged scale, from the opposite side;

in FIG. 8, the unit of FIG. 7 in the stage of loading of a bar;

in FIG. 9, a detail of the construction of the unit for extracting the chromium-plated bars;

in FIG. 10, the extraction unit in section on the plane X—X of FIG. 9;

in FIG. 11, a partial view of the unit of FIG. 10 in the stage of seizing a bar;

in FIG. 12, a detail of the ends of two contiguous bars.

As is shown in FIGS. 1, 2, 3, in which the plant is illustrated subdivided into three portions on account of its overall size, the plant according to the present invention comprises an automatic introduction unit for the bars to be chromium-plated, referenced generally 1, a degreasing and cleaning unit for the bars 2, an electrolytic treatment unit 3, comprising a plurality of cells, a handling device for the bars 4, a final burnishing or polishing unit for the bars after chromium-plating 5, for bringing the bars to the desired surface roughness, and a unit 6 for extracting and storing the chromium-plated bars.

In greater detail, the electrolytic treatment unit 3 comprises, in correspondence with each cell 7, an electrical contact 8, advantageously of the mercury bath type, a brushing unit 9 for cleaning the bar on entry into the cell, which dresses the surface of the bar, and a further brushing unit 10 at the outlet from the cell and before entry into a new electrical contact 8, adapted for removing the bath residues that may still be present on the bar, to ensure optimum electrical contact between the surface of the bar and the mercury.

An electrical contact 8 is situated also after the last cell 7, in such a way that the total number of electrical contacts present enables the bar to be supplied with the current necessary for chromium-plating, as required for the optimum functioning of each cell, without overheating the bar itself.

The complete chromium-plating line may comprise a plurality of successive cells, for example four in number, according to the thickness of the deposited metal required and the operating conditions of the cells themselves.

The device 4 for handling the bars is composed of a unit for axially entraining the bars and for rotating them, adapted for imparting to the bars an anticlockwise rotation as viewed in the direction of movement along the chromium-plating line.

The function of this rotation is to improve the uniformity in the metal deposition within the cells, and it also enables connection between successive bars to be achieved, so as to ensure continuity of working, and disconnection of the bars after working has been terminated.

For this purpose, each bar 11, as shown in FIG. 12, is equipped with a threaded hole 12 at each end; into one of said holes of each bar fed into the plant, always at the same end, for example at the end facing towards the direction of feed of the bar in the plant, there is inserted a stud 13, having its outer end furnished with a conical taper.

The stud 13 inserted into the associated hole of the bar 11*a*, during the loading phase, can then screw into the threaded hole 12 of the bar 11*b* in front of it and already undergoing treatment, the screwing being continued until the ends of the two bars are brought into contact, thereby constituting an electrical and mechanical continuity between the successive bars, without discontinuities in their surfaces, thus enabling treatment to be carried out continuously.

For this purpose, the automatic loading unit for the bars, as shown in FIGS. 4 to 7, comprises a bench 14 for storing the waiting bars, the bench being equipped with inclined chutes 15 for supporting the bars 11 while awaiting treatment, the bench being disposed laterally of a frame 16 which carries a plurality of supports comprising rollers 17 side-by-side, adapting for supporting the bars in feed and rotation.

The frame 16 is carried by a pair of bell-crank levers 18, pivoted on the supports 19 which are fixed to the floor, and connected together by a rod 20, equipped with a longitudinal adjustment device, by means of which the levers 18 can be simultaneously rotated until they bring the supports 17 to hold the bars with their axes at the axis level provided for the fixed members of the plant, adapting themselves to the different diameters of bars being processed. The roller supports 17 are each equipped with a pair of adjacent rollers, on which the bars rest, and they can be orientated obliquely to the longitudinal axis of the plant, so as to permit the rotation and forward feed of the bars without sliding on the rollers themselves.

The bench 14 for storing the waiting bars, as shown in FIGS. 6, 7, 8, is equipped with a pair of shaped arms 21, spaced apart from each other and located near the opposite ends of the bars, these arms being pivoted at bearings 22 fixed to the frame of the bench.

To one of the arms 21 there is connected a lever 23, to the end of which there is articulated the rod of an actuator 24, by means of which the arm 21 can be rotated about the bearing 22; the other of the arms 21, situated near the opposite end of the waiting bars, is rigidly connected to the first by means of a connecting shaft 25, so that it is actuated simultaneously by means of the same actuator 24, or equivalent means for simultaneously controlling the movement of the bars 21 are provided.

The frame of the bench 14 possesses, in correspondence with each of the arms 21, a bearing projection 24 for the bars 11, which can rotate freely towards it as a result of the slope imparted to the chutes 15; the contact of the bars with the projections 26 is prevented by the presence of arresting arms 27, pivoted to the frame of the bench and adjustable in position by a control rod 28. Each arm 21 possesses an end 29, facing towards the waiting bars 11, this end being depressed, with its upper surface aligned with the plane of the chutes 15 when the arm is in the raised position, as shown in FIG. 7; at its end there is a step 30, extending as far as the level of the upper edge of the projections 26, and the arm 21 then possesses a plane upper surface 31 which continues as far as the front end of the arm itself, in correspondence with the support position for the bar on the roller supports 17, and at a level higher than them, where the arm possesses an end retaining lug 32, adapted for arresting the bar in the rotational phase on the surface 31.

As FIG. 7 shows, when the arms 21 are in the raised position, a bar 11*c* is situated in bearing against the arresting arms 27, above the upper surface of the portion 29 of the arms themselves; this position is maintained until the bar in the feeding phase has passed beyond the intended access zone, leaving the space for the feed of a succeeding bar.

The actuator 24 then causes a lowering of the arms 21, by rotation about the bearings 22, into the position illustrated in FIG. 8; this rotation of the arms 21 causes the portion 29 to be raised, which therefore brings the bar 11*c* to pass beyond the obstacle constituted of the arresting arms 27, arriving above the upper surface of the projections 26; the bar 11*c* is held in this position by the step 30. When the arms 21 are in this position, the succeeding bars 11*d* are held by the rear edge of the portion 29 of the arms themselves, against which they bear.

The following raising of the arms 21, with a return into the position of FIG. 7, brings the bar 11c to bear above the bearing projections 26, in the position indicated in FIG. 7 by the reference 11*c*', thus passing over the step 30.

In this condition, the bar 11c can now roll on the surface 31 of the arms, aligned with the upper face of the projections 26, until it reaches the position shown in broken line in FIG. 7, against the retaining lugs 32.

The renewed lowering of the arms 21 then deposits the bar, as indicated by the reference 11*c*'' in FIG. 8, onto the roller supports 17, while a new bar comes into the waiting position against the step 30.

The frame 16 also carries several cranked arms 33, equipped with rollers 34, driven by means of a common motor 35; the arms 33 are pivotally supported in a median position on the frame 16 and are connected together by a rod 36, connected to the movable rod of an actuator 37. Actuation of the actuator 37 causes rotation of the cranked arms about their respective bearings and, acting through the rollers 34, raises the bar 11*a*, during the phase of introduction into the plant, represented by the dot-and-dash line in the Figure, from the resting position on the supports 17, advancing the bar until its front end comes to bear against the rear end of the bar 11*b*, already undergoing treatment in the plant.

The stud 31 present on the front end of the bar 11*a* then engages into the threaded hole 12 of the bar 11*b*, and the rotation imparted by the drive unit 4 causes the stud to screw into the hole until the connection between the bars is completed.

This screwing-up results from the fact that the bar 11*a* is held, stopped in rotation, on the rollers 34, by means of the friction exerted on them, while the bar 11*b* in front of it rotates: for the purpose of increasing this friction, especially in the case of bars of small diameter, a counter-pressure roller 38 is provided, equipped with an associated actuator 39, by which the bar 11*a* is held pressed against the rollers 34.

When screwing-up is completed, after a predetermined time, the rollers 34 descend, leaving the bar on the roller supports 17, which now permit free rotation of the bar during feed.

The last of the roller supports 17 of the loading unit, indicated in the Figure by the reference 17*a*, is equipped with a device for sensing the rotation of the bar, composed of an angular position detector, for example of the type known as "encoder", which signals to an alarm circuit a lack of rotation of the bar resting on it.

Said lack of rotation, in fact, indicates that the correct connection has not been made between the last bar of the train of bars undergoing treatment, which is kept in rotation by the handling device 4, and the new bar to be introduced; in this case, therefore, an interruption of continuity between the bars in feed would exist, a cause of loss of liquid in the cells and in the electrical immersion contacts, with serious disadvantages in the plant.

The signalling of the absence of rotation of the bar then permits timely intervention, removing the cause of the anomalous functioning, before the non-connected bar is fed forward into the plant.

The extraction and storage unit 6 for the chromium-plated bars, illustrated in FIGS. 9, 10, 11, comprises a frame 40, adjustable in height by means of cranked support arms 18, analogously to the frame 16, with associated support rollers 17, on which the chromium-plated bars run and revolve, and a frame 41, equipped with longitudinal guide bars 42 for a carriage 43, which can be advanced along them by means of an actuator 44; the carriage 43 possesses jaws 45, which can be clamped onto a discharged bar by means of an actuator 46. Laterally of the frame 40, as shown in FIGS. 10, 11, there is a collecting bench 47 for the chromium-plated bars, the bench being equipped with a pair of spaced-apart arms 48, situated in positions near the ends of the bar located in the extraction position; the arms 48 are actuated in rotation about their respective pivot bearings by means of an actuator 49, acting on a lever 50, integral in rotation with the arms themselves.

The front ends 51 of the arms 48, when the arms are in the lowered position, extend above the frame 40, and below the feed position of the bar 11 undergoing discharge, resting on the support rollers 17, whereas in the raised position the arms 48 raise the bar off its supports 17, providing an inclined plane for the bar to roll towards the storage zone 52.

The carriage 43 carries a sensor with photo-electric cell or the like 53, adapted for detecting the presence of a bar between the jaws 45, disposed in the open position; in such a condition, a command is given to close the jaws onto the bar, which is therefore gripped and blocked in rotation.

The actuator 44 at the same time causes the carriage 43 to advance, at the same feed speed as the bar fed from the entraining and rotating unit 4, which acts upon a bar following that which is gripped by the jaws 45.

The rotation of the preceding bar, while the bar being discharged is gripped by the jaws 45, causes unscrewing of the stud 13, releasing the bar; when unscrewing has been completed, the carriage advances further, removing the now disengaged bar from the succeeding one, as far as a position in which, by means of a limit switch 54 or the like, the jaws 45 are instructed to open and rapid advance of the carriage takes place as far as a position in which it is no longer an obstacle to removal of the bar by means of the arms 48, this position being defined by the limit switch 55; after the bar has been moved away, the carriage then returns into the starting position, to be ready for unscrewing the next bar.

The bar introduction and bar extraction units may be loaded and unloaded with bars by hand, or they may be equipped with other automatic conveying devices, especially in the case where the bars treated in the plant are to be subjected to other preventive or succeeding operations.

For the purpose, moreover, of increasing the potential of the plant, this plant may comprise two lines parallel and side by side, as indicated schematically in FIGS. 6, 10, where the second line is partially indicated.

Other devices for controlling, actuating and handling may be provided for each of the units or elements of the plant, such as also electrical control and feed devices for the cells, which may be of known type and are therefore not described in detail.

Numerous variants may be introduced, without thereby departing from the scope of the invention, in its general characteristics.

I claim:

1. Automatic plant for continuous electroplating treatment of metal bars, characterized by the fact that it comprises, successively, an automatic introduction unit for bars to be treated, a degreasing and cleaning unit for the bars, an electrolytic treatment unit having one or more consecutive cells and associated devices for electrical contact with the bars in movement, a handling device for the bars, a final burnishing or polishing unit for the bars and an extraction and storage unit for the treated bars, in which the automatic introduction unit for the bars possesses means for the mutual electrical and mechanical connecting together in alignment of the bars successively introduced, and the extraction unit possesses means for separating the successive bars and for storing them side by side, the handling device for the bars carrying out their entrainment in the axial direction and simultaneous rotation of the bars about themselves.

2. Automatic plant for continuous electroplating treatment of metal bars according to claim 1, characterized by the fact that at one end of each bar there are present screw means capable of being coupled to corresponding screw means present on the facing end of the axially contiguous bar, thereby achieving the mechanical connection and electrical connection between the successive bars themselves.

3. Automatic plant for continuous electroplating treatment of metal bars, according to claim 2, characterized by the fact that the corresponding screw means situated at the ends of each bar are constituted, at one end, of a threaded stud projecting axially and, at the opposite end, of a threaded axial hole, adapted for engaging onto the stud projecting from the contiguous bar.

4. Automatic plant for continuous electroplating treatment of metal bars, according to claim 2, characterized by the fact that the screw means have a right-hand thread, and in correspondence with them the handling device for the bars causes the bars to rotate in an anticlockwise direction as viewed in the direction of feed of the bars in the plant.

5. Automatic plant for continuous electroplating treatment of metal bars according to claim 1, characterized by the fact that the automatic introduction unit for the bars is composed of a bench having inclined chutes, adapted for receiving the waiting bars, adjacent to a frame equipped with means for rolling support and feed of a bar and equipped with means for rotationally blocking the bar itself, there being provided a transfer apparatus for a single bar, from among the bars present, from the chutes of the bench to the support and feed means, with a movement transverse to the axis of the bar, in which the feed means are adapted for axially feeding the bar present on them into contact with the last of the bars already undergoing treatment in the plant, and the rotational blocking means are adapted for preventing the free rotation of the bar for a preselected period, thereby achieving coupling between the corresponding screw means present respectively on the last bar already undergoing treatment in the plant, which is being driven in rotation, and the next supplied bar, carried by the automatic introduction unit for the bars.

6. Automatic plant for continuous electroplating treatment of metal bars according to claim 5, characterized by the fact that the means for rolling support of the bars are constituted of pairs of side-by-side rollers, with their axes parallel or forming a small angle to the direction of feed of the bars.

7. Automatic plant for continuous electroplating treatment of metal bars, according to claim 5, characterized by the fact that the feed means are composed of motor-driven rollers, having their axes transverse to the feed direction of the bars, situated beneath the level of the support rollers for the bars themselves, and capable of being raised to a level higher than that of the rollers themselves in order to determine the feed of the bar resting upon them without rotating it.

8. Automatic plant for continuous electroplating treatment of metal bars, according to claim 5, characterized by the fact that the means for rotationally blocking the bar are constituted of the feed rollers with transverse axes, exerting friction upon the bar itself, in association with one or more higher rollers having axes transverse to the direction of feed of the bar, each equipped with an actuator for pressing the bar onto the transverse rollers.

9. Automatic plant for continuous electroplating treatment of metal bars, according to claim 1, characterized by the fact that the apparatus for transferring a single bar to the support and feed frame for the bars is constituted of at least one pair of arms, oscillating about an intermediate bearing, with their front ends extending as far as the feed axis of the bar on the frame, these arms being equipped with an actuator device for moving them between a raised position, with their front ends at a level higher than the support level of the bar on the supports of the frame, and a lowered position, with their front ends at a level lower than the support level of the bar on the supports of the frame, with their rear ends associated with corresponding bearing projections of the bench carrying the waiting bars and with arresting arms for the bars themselves, which rear ends are equipped with shaped profiles having a depressed end portion which is aligned, in the raised position of the arms, with the chutes of the bench, and having a step for connection with the upper edge of the arms, the step being aligned, in the raised position, with the bearing projections of the bench.

10. Automatic plant for continuous electroplating treatment of metal bars, according to claim 1, characterized by the fact that the automatic introduction unit for the bars comprises sensor devices for the rotation of the last bar fed into the plant, adapted for signalling lack of rotation of the bar itself resulting from a defect in its connection to the train of bars undergoing treatment.

11. Automatic plant for continuous electroplating treatment of metal bars, according to claim 10, characterized by the fact that the sensor devices for the rotation of the last bar are composed of an electronic detector of angular position rotatably coupled to the last of the pairs of support rollers for the bar in the automatic introduction unit.

12. Automatic plant for continuous electroplating treatment of metal bars, according to claim 1, characterized by the fact that the extraction and storage unit for the treated bars is composed of a frame, equipped with rolling support devices for the bars, carrying a carriage movable parallel to the longitudinal axis of the bars, equipped with jaws which can be clamped around the front bar present on the extraction unit, there being present laterally to this a storage bench for the bars, equipped with arms for seizing and transferring the bars onto it, the jaws blocking rotation of the bar clamped by them, during the feed of the carriage parallel to the bar and determining, in this manner, the unscrewing and separation of the screw means which connect the front bar to the succeeding bar.

13. Automatic plant for continuous electroplating treatment of metal bars, according to claim 1, characterized by the fact that, before and after each electrolytic treatment cell, there is situated a device for electrical contact with the bars advancing in the cells.

14. Automatic plant for continuous electroplating treatment of metal bars, according to claim 13, characterized by the fact that the devices for electrical contact with the bars are closed tanks containing a mercury bath.

15. Automatic plant for continuous electroplating treatment of metal bars according to claim 1, characterized by the fact that, before each electrolytic treatment cell, after the electrical contact device, there is present a device with moving brushes for dressing the surface of the bar.

* * * * *